US005338639A

United States Patent [19]

Schroeder et al.

[11] Patent Number: 5,338,639

[45] Date of Patent: Aug. 16, 1994

[54] ELECTROSTATIC TONER CONTAINING A KETO COMPOUND AS A CHARGE STABILIZER

[75] Inventors: Gunter-Rudolf Schroeder, Heidelberg; Udo Mayer, Frankenthal, both of Fed. Rep. of Germany

[73] Assignee: BASF Aktiengesellschaft, Ludwigshafen, Fed. Rep. of Germany

[21] Appl. No.: 90,042

[22] PCT Filed: Mar. 11, 1992

[86] PCT No.: PCT/EP92/00534

§ 371 Date: Jul. 20, 1993

§ 102(e) Date: Jul. 20, 1993

[87] PCT Pub. No.: WO92/16878

PCT Pub. Date: Oct. 1, 1992

[30] Foreign Application Priority Data

Mar. 20, 1991 [DE] Fed. Rep. of Germany ..... 4109086

[51] Int. Cl.[5] ..... G03G 9/097

[52] U.S. Cl. ..... 430/110

[58] Field of Search ..... 430/110

[56] References Cited

U.S. PATENT DOCUMENTS 4,265,990 5/1981 Stolka et al. ..... 430/59
5,028,508 7/1991 Lane et al. ..... 430/115

FOREIGN PATENT DOCUMENTS 61-26058 2/1986 Japan .
190344 8/1986 Japan ..... 430/110
61-212851 9/1986 Japan .
61-212852 9/1986 Japan .
125366 6/1987 Japan ..... 430/110
WO92/00553 1/1992 PCT Int'l Appl. .
WO92/05476 4/1992 PCT Int'l Appl. .

OTHER PUBLICATIONS

Organikum, 18th Edition, pp. 479–481, 1990.

*Primary Examiner*—Roland Martin
*Attorney, Agent, or Firm*—Oblon, Spivak, McClelland, Maier & Neustadt

[57] ABSTRACT

Electrostatic toners contain a polymeric binder and, as a charge stabilizer, a compound of the formula

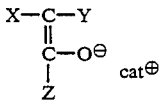

where Z is $C_1$–$C_{20}$-alkyl which is unsubstituted or substituted by phenyl or Z is $C_5$–$C_7$-cycloalkyl or unsubstituted or substituted phenyl, X and Y are each cyano or a radical of the formula —CO—$OR^1$, —CO—$NR^1R^2$ or —C—$R^3$, where $R^2$ is $C_1$–$C_{20}$-alkyl which is unsubstituted or substituted by phenyl or $R^1$ is $C_5$–$C_7$-cycloalkyl, $R^2$ is hydrogen or $C_1$–$C_4$-alkyl and $R^3$ is $C_1$–$C_{20}$-alkyl which is unsubstituted or substituted by phenyl or $R^3$ is $C_5$–$C_7$-cycloalkyl or unsubstituted or substituted phenyl, or X and Y together form a radical of the formula —CO—L—CO— or —CO—CH=C($CH_3$)—O—CO—, where L is $C_2$–$C_4$-alkylene, and cat⊕ is one equivalent of a cation.

8 Claims, No Drawings

ELECTROSTATIC TONER CONTAINING A KETO COMPOUND AS A CHARGE STABILIZER

The present invention relates to novel electrostatic toners containing a polymeric binder and, as a charge stabilizer, a compound of the formula I

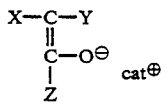

(I)

where Z is $C_1$–$C_{20}$-alkyl which is unsubstituted or substituted by phenyl or Z is $C_3$–$C_7$-cycloalkyl or unsubstituted or substituted phenyl, X and Y are identical or different and, independently of one another, are each cyano or a radical of the formula —CO—$OR^1$, —CO—$NR^1R^2$ or —CO—$R^3$ where $R^1$ is $C_1$–$C_{20}$-alkyl which is unsubstituted or substituted by phenyl or $R^1$ is $C_5C_7$-cycloalkyl, $R^2$ is hydrogen or $C_1$–$C_4$-alkyl and $R^3$ is $C_1$–$C_{20}$-alkyl which is unsubstituted or substituted by phenyl or $R^3$ is $C_5$–$C_7$-cycloalkyl or unsubstituted or substituted phenyl, or X and Y together form a radical of the formula —CO—L—CO— or —CO—CH=C($CH_3$)—O—CO—, where n is $C_2$–$C_4$-alkylene, and cat⊕ is one equivalent of a cation.

Latent electrostatic image recordings are developed by depositing the toner inductively on the electrostatic image. The charge stabilizers stabilize the electrostatic charge of the toner. This makes the image stronger and gives crisper contours.

The charge stabilizers used must meet a wide range of requirements:

Ability to develop the latent electrostatic image into a deep-colored visible image.

Easy distribution in the toner formulation in order to produce a fault-free, uniform image having crisp contours.

Insensitivity to moisture.

High thermal stability.

JP-A-26 058/1986, JP-A-212 851/1986 or JP-A-212 852/1986 disclose electrostatic toners which contain metal salts of β-dicarbonyl compounds as charge stabilizers.

However, we have found that the prior art charge stabilizers frequently fail to meet the requirements completely.

It is an object of the present invention to provide a novel electrostatic toner which has charge stabilizers which possess advantageous performance characteristics.

We have found that this object is achieved by the electrostatic toners defined at the outset.

If one or both of the radicals X and Y in the formula I have a carbonyl group, the charge stabilizer of the formula I may occur in various tautomeric forms, all of which are embraced by the claim.

The following tautomeric forms are examples:

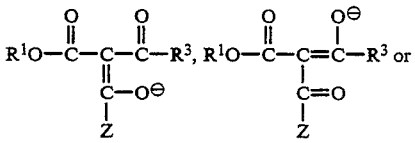

-continued

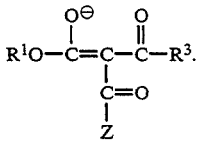

All alkyl and alkylene groups occurring in the above-mentioned formula may be either straight-chain or branched.

If substituted phenyl groups occur in the abovementioned formula I, examples of suitable substituents are $C_1$–$C_{20}$-alkyl or $C_1$–$C_{20}$-alkoxy. The phenyl groups are as a rule monosubstituted to trisubstituted.

Z,$R^1$, $R^2$ and $R^3$ for example methyl ethyl propyl, isopropyl, butyl, isobutyl, sec-butyl or tertbutyl.

Z,$R^1$ and $R^2$ are furthermore, for example, pentyl, isopentyl, neopentyl, tert-pentyl, hexyl, heptyl, 1-ethylpentyl, octyl, isooctyl, 2-ethylhexyl, nonyl, isononyl, decyl, isodecyl, undecyl, dodecyl, tridecyl, isotridecyl, tetradecyl, pentadecyl, hexadecyl, heptadecyl, octadecyl, nonadecyl, eicosyl (the above names isooctyl, isononyl, isodecyl and isotridecyl are trivial names derived from the alcohols obtained in the oxo process; cf. Ullmanns Encyklopädie der technischen Chemie, 4th Edition, Volume 7, pages 215 to 217, and Volume 11, pages 435 and 436), benzyl, 1-or 2-phenylethyl, cyclopentyl, cyclohexyl or cycloheptyl.

Z and $R^3$ are furthermore, for example, phenyl, 2-, 3- or 4-methylphenyl, 2-, 3- or 4-ethylphenyl, 2-, 3-or 4-propylphenyl, 2-, 3- or 4-isopropylphenyl, 2-, 3-or 4-butylphenyl, 2-, 3- or 4- ( 2-ethylhexyl ) -phenyl, 2,4-dimethylphenyl, 2,4,6-trimethylphenyl, 2-, 3- or 4-methoxyphenyl, 2-, 3-or 4-ethoxyphenyl, 2-, 3-or 4-propoxyphenyl, 2-, 3- or 4-butoxyphenyl, 2-, 3- or 4- ( 2-ethylhexyloxy)-phenyl, 2,4-dimethoxyphenyl or 2,4,6-trimethoxyphenyl.

L is, for example, —$CH_2$—, —$(CH_2)_2$—, —$(CH_2)_3$—, —$(CH_2)_4$—, —CH—($CH_3$)—$CH_2$—, —CH($CH_3$)—CH($CH_3$)— or CH($CH_3$)—$CH_2)_2$—.

Suitable cations cat⊕ are derived from, for example, hydrogen or a metal.

Preferred electrostatic toners are those which contain a compound of the formula I where Z is $C_1$–$C_{20}$-alkyl or unsubstituted or substituted phenyl and X and Y independently of one another are each a radical of the formula —CO—$OR^1$ or —CO—$R^3$ where $R^1$ is $C_1$–$C_{20}$-alkyl and $R^3$ is $C_1$–$C_{20}$-alkyl or phenyl.

Other preferred electrostatic toners are those which contain a compound of the formula I where cat⊕ is a proton, a cation derived from a metal of group IA of the periodic table of the elements, or one equivalent of a cation derived from a metal of group IIA of the periodic table of the elements.

Particularly preferred electrostatic toners are those which contain a compound of the formula I where Z is $C_1$–$C_{20}$-alkyl, X is —CO—$OR^1$, where $R^1$ is $C_1$–$C_{20}$-alkyl, and Y is —CO—$R^3$ where $R^3$ is $C_1$–$C_{20}$-alkyl or phenyl Other particularly preferred electrostatic toners are those which contain a compound of the formula I where cat⊕ is a proton, a lithium, sodium or potassium ion or one equivalent of a magnesium, calcium or barium ion.

Electrostatic toners which contain mixtures of compounds of the formula I are also noteworthy. A distinction may be made between the following mixtures:

mixtures of the same keto compound and different cations mixtures of different keto compounds and the same cations mixtures of different keto compounds and different cations.

Particular examples are electrostatic toners which contain mixtures of the same keto compound and different cations, in particular calcium and barium ions.

The components may be present in any ratio in the mixtures. Particularly noteworthy mixtures of calcium and barium salts are those whose molar ratio of calcium salt to barium salt is from 1:1 to 99:1.

Such mixtures can be prepared either by mechanical mixing or directly during the synthesis of the salts.

The amount of the charge stabilizers of the formula I in the electrostatic toner is, as a rule, from 0.01 to 2% by weight, based on the weight of the toner.

The polymeric binders present in the novel electrostatic toners are known per se. As a rule, they are thermoplastic and have a softening point of from 40° to 200° C. preferably from 50° to 130° C. in particular from 5° to 115° C. Examples of polymeric binders are polystyrene, copolymers of styrene with an acrylate or methacrylate, copolymers of styrshe with butadiene and/or acrylonitrile, polyacrylates, polymethacrylates, copolymers of an acrylate or methacrylate with vinyl chloride or vinyl acetate, polyvinyl chloride, copolymers of vinyl chloride with vinylidene chloride, copolymers of vinyl chloride with vinyl acetate, polyester resins, epoxy resins, polyamides or polyurethanes.

In addition to the compounds of the formula I and the polymeric binders, the novel toners may contain known amounts of colorants and magnetically attractable material. The colorants may be organic dyes or pigments, such as nigrosene, Aniline Blue, 2,9-dimethylquinacridone, C.I. Disperse Red (C.I. 6,010), C.I. Solvent Red 19 (C.I. 26,050), C.I. Pigment Blue 15 (C.I. 74,160), C.I. Pigment Blue 22 (C.I. 69,810) or C.I. Solvent Yellow 16 (C.I. 12,700), or inorganic pigments, such as carbon black, red lead, yellow lead oxide or chrome yellow. In general, the amount of the colorant present in the toner does not exceed 15% by weight, based on the weight of the toner.

The magnetically attractable material may be, for example, iron, nickel, chromium oxide, iron oxide or a ferrite of the formula II $$MeFe_2O_4 \quad (II)$$

where Me is a divalent metal, eg. iron, cobalt, zinc, nickel or manganese.

The compounds of the formula I which are present in the novel toners are known per se and are described in, for example, Organikum, 18th edition, pages 479 to 481, 1990, or can be obtained by the methods described there. The Examples also describe the preparation of several compounds of the formula I.

The toners containing the compounds I as charge stabilizers are prepared by conventional processes, for example by mixing the components in a kneader and then pulverizing the mixture, or by melting the polymeric binder or a mixture of the polymeric binders, then finely dispersing one or more compounds of the formula I and, where used, the other additives in the molten resin using the mixing and kneading apparatuses known for this purpose, then cooling the melt to give a solid mass and finally milling the solid mass to give particles of the desired particle size (as a rule from 0.1 to 50 μm).

It is also possible to suspend the polymeric binder and the charge stabilizer I in the same solvent and to add the other additives to the suspension. The suspension can thus be used as liquid toner.

However, the liquid may also be spray-dried in a conventional manner or the solvent evaporated off and the solid residue milled to give particles of the desired particle size.

Instead of dissolving the charge stabilizers I, it is also possible to disperse them finely in a solution of the polymeric binder. The toner formulation thus obtained can then be used in a xerographic image recording system, for example according to U.S. Pat. No. 4 265 990.

The compounds of the formula I are advantageous charge stabilizers. As a rule, they meet the requirements defined at the outset and in particular are distinguished by the fact that, when added to a toner preparation, they impart to it an advantageous electrostatic charge profile, i.e. toners can be charged rapidly and to a high degree. Furthermore, the novel charge stabilizers ensure that the charge is kept constant at a high level.

The Examples which follow illustrate the invention.

A) Preparation of the compounds of the formula I

EXAMPLE H1

Isopropyl 2-acetylacetoacetate 5 ml of tetrachloromethane are added to 23.3 g (1 mol) of magnesium turnings in 50 ml of dry ethanol under nitrogen and in the absence of moisture. After the beginning of gas evolution, a solution of 147.1 g (1 mol) of isopropyl acetoacetate in 100 ml of dry ethanol was slowly added dropwise, the reaction mixture being kept at the reflux temperature. Stirring was carried out for a further 4 hours at this temperature, after which the mixture was cooled. 78.5 g (1 mol) of acetyl chloride was slowly added dropwise at 10° C. Stirring was continued for a further 4 hours at room temperature and hydrolysis was then effected with a mixture of 450 ml of ice water and 25 ml of concentrated sulfuric acid. The organic phase was separated off, dried, and evaporated down under reduced pressure. 192.3 g of >96% pure isopropyl 2-acetylacetoacetate were obtained.

EXAMPLE H2

Sodium salt of isopropyl 2-acetylacetoacetate 147.8 g (0.75 tool) of isopropyl 2-acetylacetoacetate were dissolved in 300 ml of dry ethanol, and a solution of 30.0 g of sodium hydroxide in 400 ml of ethanol was added. After the solvent had been removed under reduced pressure, 85.32 g of the sodium salt were obtained as a colorless powder.

Analysis: Na Calculated 11.0: Found 12.0.

EXAMPLE H3

Calcium salt of isopropyl 2-acetylacetoacetate 9.8 g ( 0.05 mol) of isopropyl 2-acetylacetoacetate were suspended in 400 ml of water and were brought into solution with 4 g of 50% strength by weight sodium hydroxide solution at a pH of 8. 3.7 g of calcium hydroxide were dissolved in 100 ml of water with the addition of acetic acid, so that the final pH was 5.6. The solutions were combined and the resulting precipitate was filtered off. 3 g of the calcium salt of isopropyl 2-acetylacetoacetate were obtained.

Analysis: Ca Calculated 9.8: Found 9.1.

EXAMPLE H4 tert-Butyl 2-acetylacetoacetate 5 ml of tetrachloromethane were added to 24.3 g (1 mol) of magnesium turnings in 50 ml of dry ethanol under nitrogen and in the absence of moisture. After the beginning of gas evolution, a solution of 177.7 g (1 mol) of tert-butyl acetoacetate in 100 ml of dry ethanol was slowly added dropwise, the reaction mixture being kept at the reflux temperature. Stirring was carried out for a further 4 hours at this temperature, after which the mixture was cooled. 78.5 g (1 mol) of acetyl chloride was slowly added dropwise at 10° C. Stirring was continued for a further 4 hours at room temperature and hydrolysis was then effected with a mixture of 450 ml of ice-water and 25 ml of concentrated sulfuric acid. The organic phase was separated off, dried, and evaporated down under reduced pressure. 192.3 g of >96% pure tert-butyl 2-acetylacetoacetate were obtained.

EXAMPLE H5

Magnesium salt of tert-butyl 2-acetylacetoacetate 40.0 g (0.2 mmol) of tert-butyl 2-acetylacetoacetate were suspended in 400 ml of water and were brought into solution with 16 g of 50% strength by weight sodium hydroxide solution at pH 8. 5.8 g of magnesium hydroxide were dissolved in 100 ml of water with the addition of glacial acetic acid, so that the final pH was 5.6. The solutions were combined and the resulting precipitate was filtered off and dried. 41.5 g of the magnesium salt were obtained.

Analysis: Mg Calculated 5.8: Found 5.1.

EXAMPLE H6

Calcium salt of tert-butyl 2-acetylacetoacetate 10.46 g ( 0.05 mol ) of tert-butyl 2-acetylacetoacetate were suspended in 200 ml of water and were brought into solution with 4 g of 50% strength by weight sodium hydroxide solution at pH 10. 1.85 g of calcium hydroxide were dissolved in 100 ml of water, the pH being kept at 8 with glacial acetic acid. The solutions were combined and the resulting precipitate was filtered off and dried. 5.1 g of the calcium salt were obtained.

Analysis: Ca Calculated 8.4: Found 9.1.

EXAMPLE H7 tert-Butyl 2-benzoylacetoacetate 5 ml of tetrachloromethane were added to 24.3 g (1 mol) of magnesium turnings in 50 ml of dry ethanol under nitrogen and in the absence of moisture. After the beginning of gas evolution, a solution of 177.7 g (1 mol) of tert-butyl acetoacetate in 100 ml of dry ethanol was slowly added dropwise, the reaction mixture being kept at reflux temperature. Stirring was carried out for a further 4 hours at this temperature, after which the mixture was cooled. 78.5 g (1 mol) of benzoyl chloride was slowly added dropwise at 10° C. Stirring was continued for a further 4 hours at room temperature and hydrolysis was then effected with a mixture of 450 ml of ice water and 25 ml of concentrated sulfuric acid. The organic phase was separated off, dried, and evaporated down under reduced pressure. 192.3 g of >96% pure tert-butyl 2-benzoylacetoacetate were obtained.

EXAMPLE H8

Magnesium salt of tert-butyl 2-benzoylacetoacetate 26.8 g (0.1 mol) of tert-butyl 2-benzoylacetoacetate were suspended in 100 ml of water and were brought into solution with 8 g of 50% strength by weight sodium hydroxide solution at pH 8. 2.92 g (0.05 mol) of magnesium hydroxide were dissolved in 100 ml of water with the addition of glacial acetic acid, so that the pH was 5.6. The solutions were combined and the resulting precipitate was filtered off and dried. 32.2 g of the magnesium salt were obtained.

Analysis: Mg Calculated 4.7: Found 4.7.

EXAMPLE H9

Isopropyl 2-benzoylacetoacetate was prepared from isopropyl acetoacetate and benzoyl chloride similarly to Example H7 and was converted into the magnesium salt by reaction with magnesium hydroxide (similarly to Example H8).

Analysis: Mg Calculated 6.2: Found 5.8.

EXAMPLE H10

Strontium salt of isopropyl 2-acetylacetoacetate 9.3 g ( 0.05 mol ) of isopropyl 2-acetylacetoacetate were added to 50 ml of water. The pH was then brought to 10–11 by the dropwise addition of 50% strength by weight sodium hydroxide solution. During this procedure, the propyl [sic] 2-acetylacetoacetate went into solution. A solution of 5.29 g (0.025 mol ) of strontium nitrate in 25 ml of water was added dropwise in the course of 1 hour. The white precipitate formed was filtered off, washed with water and dried.

Yield: 7.22 g (63%) found C: 45.6%, H: 5.8%, Sr: 18.8 %. calc. C: 47.2%, H: 5.7%, Sr: 19.1%.

EXAMPLE H11

Barium salt of isopropyl 2-acetylacetoacetate 9.3 g (0.05 mol) of isopropyl 2-acetylacetoacetate were added to 50 ml of water. The pH was then brought to 10–11 by the dropwise addition of 50% strength by weight sodium hydroxide solution. During this procedure, the propyl [sic] 2-acetylacetoacetate went into solution. A solution of 6.84 g (0.025 mol) of barium acetate monohydrate in 25 ml of water was added dropwise in the course of 1 hour. The white precipitate formed was filtered off, washed with water and dried.

Yield: 5.3 g (42%) found C: 39.5%, H: 5.2%, Ba.: 26.8%. calc. C: 42.6%, H: 5.2%, Ba: 27.1%.

EXAMPLE H12

2 -Acetyldibenzoylmethane 57.22 g (0.5 mol) of magnesium ethylate in 200 ml of toluene were heated to the boil. 112.13 g (0.5 mol) of dibenzoylmethane, dissolved in 300 ml of toluene, were then added dropwise in the course of 1 hour. After refluxing for three hours, the mixture was cooled to 10° C. and 39.25 g (0.5 mol) of acetyl chloride were added dropwise at a rate such that the temperature did not exceed 10° C. A mixture of 225 g of ice and 12.5 ml of concentrated sulfuric acid was then added to the reaction mixture. The organic phase was separated off, dried over sodium sulfate and evaporated down under reduced pressure. The colorless product crystallized. 99.8 g (89%) of 2-acetyldibenzoylmethane (melting point: 77°–80° C.) were obtained by filtering off and drying.

EXAMPLE H13

Calcium salt of 2-acetyldibenzoylmethane 13.2 g ( 0.05 mol ) of 2-acetyldibenzoylmethane were added to 50 ml of water. The pH was then brought to 12 by the dropwise addition of 50% strength by weight sodium hydroxide solution. During this procedure, 2-acetyldibenzoylmethane went into solution. A solution of 3.96 g ( 0.025 tool ) of calcium acetate monohydrate in 25 ml of water was added dropwise in the course of 1 hour. The yellow precipitate formed was filtered off, washed with water and dried.

Yield: 13.94 g (97.4%) Melting range: 196° to 220° C. found: C: 68.5%, H: 4.9%, Ca: 7.0%. calc. C: 71.2%, H: 4.9%, Ca: 6.6%.

EXAMPLE H14

Calcium/barium salt of tert-butyl 2-acetylacetoacetate (preparation in synthesis)

10.0 g ( 0.05 tool ) of tert-butyl 2-acetylacetoacetate were added to 50 ml of water. The pH was then brought to 12 by the dropwise addition of 50% strength by weight sodium hydroxide solution. A homogeneous solution formed. A solution of 3.79 g (0.024 mol) of calcium acetate monohydrate and 0.27 g (0.001 mol) of barium acetate monohydrate in 25 ml of water was added dropwise in the course of 1 hour. The white precipitate formed was filtered off, washed with water and dried.

Yield: 5.6 g (50%) found: Ca: 7.8%, Ba: 1.0%. calc.: C:a [sic]8.6%, Ba: 1.2%.

The mixtures shown in Table 1 below and of the formula

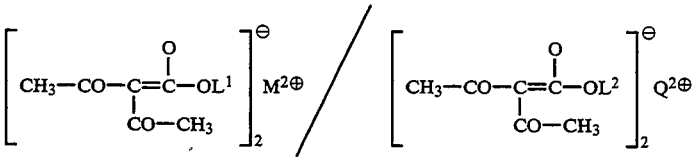

are obtained in a similar manner.

TABLE 1

| Ex. No. | $L^1$ | M | Mol-% | $L^2$ | Q | Mol-% |
|---|---|---|---|---|---|---|
| H15 | t-Bu*) | Ca | 97.5 | t-Bu | Ba | 2.5 |
| H16 | i-Pr*) | Ca | 50 | i-Pr | Ba | 50 |
| H17 | i-Pr | Ca | 67 | i-Pr | Ba | 33 |
| H18 | i-Pr | Ca | 90 | i-Pr | Ba | 10 |
| H19 | i-Pr | Ca | 99 | i-Pr | Ba | 1 |
| H20 | i-Pr | Ca | 50 | i-Pr | Sr | 50 |
| H21 | t-Bu | Ca | 50 | i-Pr | Ba | 50 |

*)Bu = $C_4H_9$, Pr = $C_3H_7$

EXAMPLE H22

A mixture of 21 g ( 0. 048 tool ) of the calcium salt of tert-butyl 2-acetylacetoacetate and 1.1 g (0.002 mol) of the barium salt of tert-butyl 2-acetylacetoacetate was produced by thoroughly grinding the two components in a mortar.

EXAMPLE H23

A -mixture of 67 mol % of the calcium salt of isopropyl 2-acetylacetoacetate and 33 mol % of the barium salt of isopropyl 2-acetylacetoacetate was produced similarly to Example H22. B) Use The Use Examples were carried out using colorant-free toner models consisting of resin and the novel charge stabilizers.

I. Preparation of the toners

EXAMPLE A1

0.2 g of the sodium salt of isopropyl 2-acetylacetoacetate (Example H2) was introduced into a solution of 10 g of a noncrosslinked styrene/butyl acrylate resin in 100 ml of xylene at room temperature, and the mixture was then freeze dried.

EXAMPLE A2

10 g of a noncrosslinked styrene/butyl acrylate resin and 0.2 g of the sodium salt of isopropyl 2-acetylacetoacetate (Example H2) were thoroughly mixed in a mixer, kneaded at 120° C. extruded and milled Toner particles having a mean particle size of 15 μm were produced by sieving.

II. Preparation of the developers and testing

For the preparation of a developer, 99% by weight of a steel carrier which had a particle size of 50 μm were accurately weighed in with 1% by weight of the toner and activated for 30 minutes on a roller stand. The electrostatic charge of the developer was then determined. About 5 g of the activated developer were introduced into a hard blow-off cell which was connected electrically to an electrometer, in a commercial q/m meter (Epping GmbH, Neufahrn). The mesh size of the sieve used in the measuring cell was 50 μm.

This ensured that the toner was blown out as completely as possible but the carrier remained in the measuring cell. The toner was removed virtually completely from the carrier particles by a vigorous air stream (about 4,000 $cm^3$/min) and simultaneous suction, the carrier particles remaining in the measuring cell. The charge of the carrier was recorded on the electrometer. It corresponded to the magnitude of the charge of the toner particles, but with the opposite sign. The magnitude of q with the opposite sign was therefore used for calculating the q/m value. By reweighing the measuring cell, the mass of the blown-out toner was determined and the electrostatic charge q/m was calculated from this.

The charge determined on the toners is summarized in Table 2 below.

TABLE 2

| Example No. | Compound from Example | Formulation of the toner* | Charge after 10 [μC/g] | 30 | 60 | 120 min |
|---|---|---|---|---|---|---|
| A1 | H2 | G | −3.1 | −8.2 | −9.6 | −10.8 |
| A2 | H2 | K | −3.2 | −5.0 | −6.3 | −6.1 |
| A3 | H3 | G | −13.8 | −20.4 | −21.1 | −22.9 |
| A4 | H1 | G | −3.2 | −5.8 | −7.4 | −8.8 |
| A5 | H5 | G | −8.3 | −13.2 | −17.6 | −19.5 |
| A6 | H6 | G | −14.1 | −13.1 | −23.4 | −25.7 |
| A7 | H4 | G | −2.8 | −5.4 | −8.1 | −11.2 |

TABLE 2-continued

| Example No. | Compound from Example | Formulation of the toner* | Charge after 10 | 30 | 60 | 120 min |
|---|---|---|---|---|---|---|
| | | | [μC/g] | | | |
| A8 | H9 | G | −8.4 | −10.8 | −12.6 | −13.1 |
| A9 | H8 | G | −6.0 | −10.6 | −13.5 | −17.5 |
| A10 | H14 | G | −17.8 | −20.0 | −20.4 | −21.2 |
| A11 | H15 | G | −17.4 | −20.4 | −20.2 | −21.3 |
| A12 | H16 | G | −13.5 | −14.6 | −15.1 | −15.7 |
| A13 | H17 | G | −15.6 | −16.1 | −17.3 | −18.0 |
| A14 | H18 | G | −18.0 | −19.7 | −20.4 | −20.5 |
| A15 | H19 | G | −17.3 | −20.5 | −21.3 | −21.7 |
| A16 | H20 | G | −10.5 | −11.5 | −12.1 | −13.7 |
| A17 | H21 | G | −13.6 | −14.3 | −15.0 | −15.3 |
| A18 | H22 | G | −17.0 | −19.7 | −20.5 | −20.9 |
| A19 | H23 | G | −15.4 | −16.0 | −17.1 | −18.0 |
| A20 | H11 | G | −9.6 | −11.4 | −12.7 | −11.8 |
| A21 | H13 | G | −14.1 | −16.7 | −19.3 | −21.4 |

*The toner was formulated either by freeze-drying according to Example A1 (denoted by G in the Table) or by kneading at above the softening point of the resin according to Example A2 (denoted by K in the Table).

We claim:

1. An electrostatic toner containing a polymeric binder and, as a charge stabilizer, a compound of the formula I

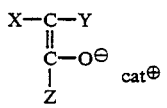

(I)

where Z is $C_1$–$C_{20}$-alkyl which is unsubstituted or substituted by phenyl or Z is $C_5$–$C_7$-cycloalkyl or unsubstituted or substituted phenyl, X and Y are identical or different and, independently of one another, are each cyano or a radical of the formula —CO—$OR^1$, —CO—$NR^1R^2$ or —CO—$R^3$, where $R^1$ is $C_1$–$C_{20}$-alkyl which is unsubstituted or substituted by phenyl or $R^1$ is $C_3$–$C_7$-cycloalkyl, $R^2$ is hydrogen or $C_1$–$C_4$-alkyl and $R^3$ is $C_1$–$C_{20}$-alkyl which is unsubstituted or substituted by phenyl or $R^3$ is $C_5$–$C_7$-cycloalkyl or unsubstituted or substituted phenyl, or X and Y together form a radical of the formula —CO—L—CO— or —CO—CH=C($CH_3$)—O—CO—, where L is $C_2$–$C_4$-alkylene, and cat⊕ is one equivalent of a cation.

2. An electrostatic toner as claimed in claim 1, containing a compound of the formula I where Z is $C_1$–$C_{20}$-alkyl or unsubstituted or substituted phenyl and X and Y independently of one another are each a radical of the formula —CO—$OR^1$ or —CO—$R^3$, where $R^1$ is $C_2$–$C_{20}$-alkyl and $R^3$ is $C_1$–$C_{20}$-alkyl or phenyl.

3. An electrostatic toner as claimed in claim 1, containing a compound of the formula I where cat⊕ is a proton, a cation derived from a metal of group IA of the periodic table of the elements or one equivalent of a cation derived from a metal of Group IIA of the periodic table of the elements.

4. An electrostatic toner as claimed in claim 1, containing a compound of the formula I where Z is $C_1$–$C_{20}$-alkyl, X is —CO—$OR^1$ where $R^1$ is $C_1$–$C_{20}$-alkyl, and Y is —CO—$R^3$ where $R^3$ is $C_1$–$C_{20}$-alkyl or phenyl 5. An electrostatic toner as claimed in claim 1, containing a compound of the formula I where cat ® is a proton, a lithium, sodium or potassium ion or one equivalent of a magnesium or calcium ion.

6. An electrostatic toner as claimed in claim 1, containing from 0.01 to 2% by weight, based on the weight of the toner, of a compound of the formula I.

7. An electrostatic toner as claimed in claim 1, additionally containing a colorant.

8. A method of developing a latent electrostatic image by contacting said image with a toner as claimed in claim 1.

* * * * *